US009217971B1

(12) United States Patent
Matsumoto et al.

(10) Patent No.: US 9,217,971 B1
(45) Date of Patent: Dec. 22, 2015

(54) FIXING DEVICE, HEATING MEMBER, AND IMAGE FORMING APPARATUS

(71) Applicant: FUJI XEROX CO., LTD., Tokyo (JP)

(72) Inventors: Mitsuhiro Matsumoto, Kanagawa (JP); Hideaki Ohara, Kanagawa (JP); Yasuhiro Uehara, Kanagawa (JP); Kazuyoshi Ito, Kanagawa (JP); Mikio Saiki, Kanagawa (JP); Hiroki Murakami, Kanagawa (JP); Junji Okada, Kanagawa (JP); Kimiyuki Kawakami, Kanagawa (JP); Tadashi Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/614,535

(22) Filed: Feb. 5, 2015

(30) Foreign Application Priority Data

Sep. 8, 2014 (JP) ..... 2014-182156

(51) Int. Cl.
*G03G 15/20* (2006.01)

(52) U.S. Cl.
CPC ..... *G03G 15/206* (2013.01); *G03G 15/2053* (2013.01)

(58) Field of Classification Search
CPC ..... G03G 15/2064; G03G 15/2053
USPC ..... 399/329, 330, 333
See application file for complete search history.

(56) References Cited

U.S. PATENT DOCUMENTS

| | | | | |
|---|---|---|---|---|
| 8,086,121 | B2 | 12/2011 | Kobayashi | |
| 8,107,857 | B2 | 1/2012 | Kobayashi | |
| 8,489,008 | B2 | 7/2013 | Iwaya et al. | |
| 8,583,020 | B2 | 11/2013 | Yoshikawa et al. | |
| 8,818,254 | B2 * | 8/2014 | Arimoto et al. | 399/329 |

FOREIGN PATENT DOCUMENTS

| | | | |
|---|---|---|---|
| JP | 2009-128887 | A | 6/2009 |
| JP | 4642879 | B2 | 3/2011 |
| JP | 2011-175168 | A | 9/2011 |
| JP | 2011-197182 | A | 10/2011 |
| JP | 2013-142834 | A | 7/2013 |

* cited by examiner

*Primary Examiner* — Hoang Ngo
(74) *Attorney, Agent, or Firm* — Sughrue Mion, PLLC

(57) ABSTRACT

A fixing device includes a rotatable endless fixing member that fixes a toner image onto a recording medium, and a heating member. The heating member includes a heat-generating layer that generates heat when supplied with electricity; an insulation layer that encloses the heat-generating layer therein to electrically insulate the heat-generating layer; a metallic layer that is laminated on a first surface of the insulation layer, has higher rigidity than the insulation layer, and generates an elastic restoring force; and a thermally conductive layer that is laminated on a second surface of the insulation layer, has lower rigidity than the metallic layer, and has higher thermal conductivity than the insulation layer and the metallic layer. The heating member is supported by one edge of the fixing member in a circumferential direction thereof, elastically deforms by being pressed against an inner peripheral surface of the fixing member, and heats the fixing member.

10 Claims, 15 Drawing Sheets

FIXING DEVICE, HEATING MEMBER, AND IMAGE FORMING APPARATUS

CROSS-REFERENCE TO RELATED APPLICATIONS

This application is based on and claims priority under 35 USC 119 from Japanese Patent Application No. 2014-182156 filed Sep. 8, 2014.

BACKGROUND

Technical Field

The present invention relates to fixing devices, heating members, and image forming apparatuses.

SUMMARY

According to an aspect of the invention, there is provided a fixing device including a rotatable endless fixing member that fixes a toner image onto a recording medium, and a heating member. The heating member includes a heat-generating layer that generates heat when supplied with electricity; an insulation layer that encloses the heat-generating layer therein so as to electrically insulate the heat-generating layer; a metallic layer that is laminated on a first surface of the insulation layer, has higher rigidity than the insulation layer, and generates an elastic restoring force; and a thermally conductive layer that is laminated on a second surface of the insulation layer, has lower rigidity than the metallic layer, and has higher thermal conductivity than the insulation layer and the metallic layer. The heating member is supported by one edge of the fixing member in a circumferential direction thereof, elastically deforms by being pressed against an inner peripheral surface of the fixing member, and heats the fixing member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the appended drawings.

First Exemplary Embodiment

Image Forming Apparatus

Figure 1:
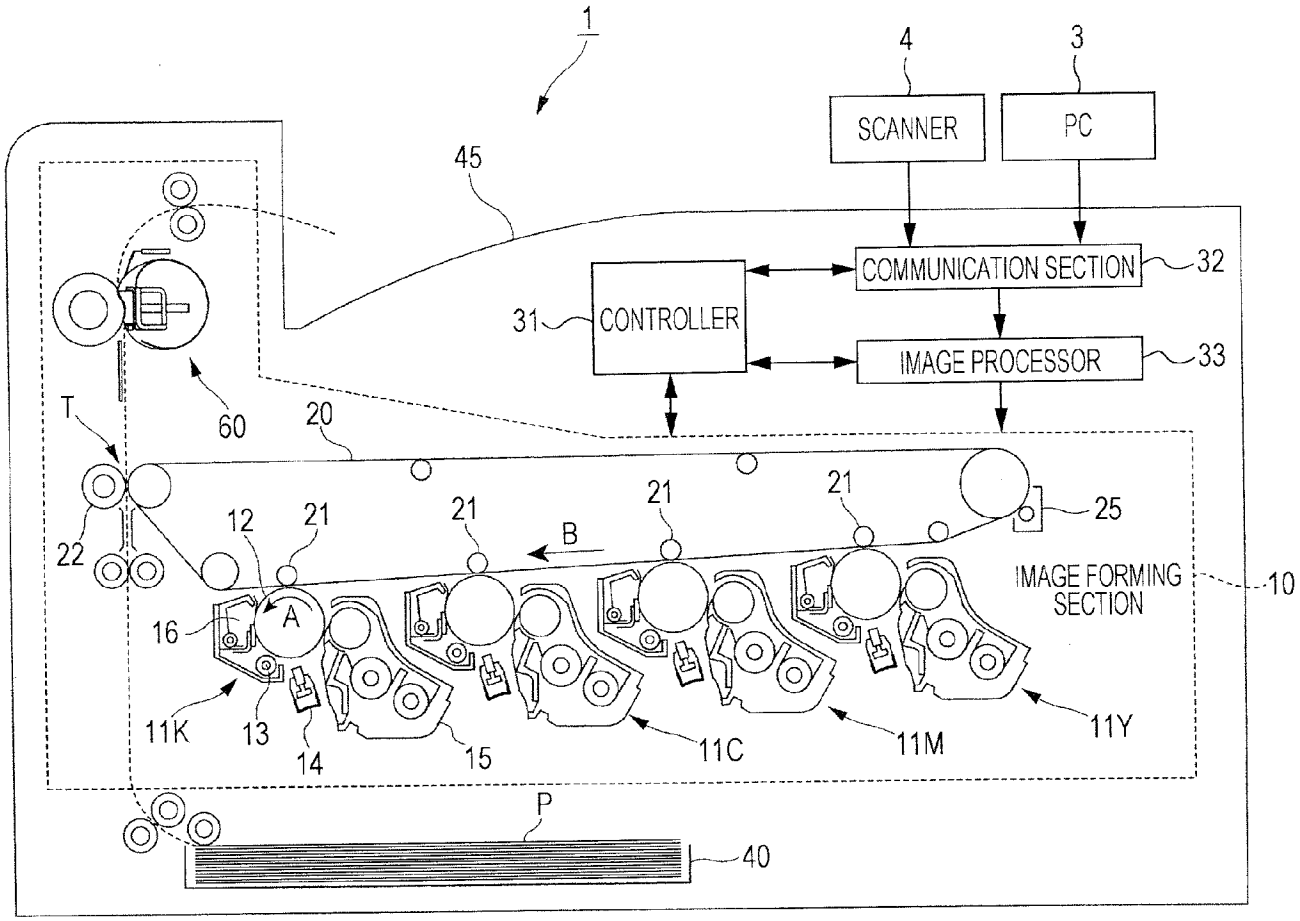
FIG. 1 illustrates a configuration example of an image forming apparatus to which a fixing unit according to a first exemplary embodiment is applied.

FIG. 1 illustrates a configuration example of an image forming apparatus 1 to which a fixing unit 60 according to a first exemplary embodiment is applied. The image forming apparatus 1 shown in FIG. 1 is a so-called tandem-type color printer and includes an image forming section 10 that forms an image based on image data, and a controller 31 that controls the overall operation of the image forming apparatus 1. Furthermore, the image forming apparatus 1 includes a communication section 32 that receives image data by communicating with, for example, a personal computer (PC) 3 or an image reader (scanner) 4, and an image processor 33 that performs predetermined image processing on the image data received by the communication section 32.

The image forming section 10 includes four image forming units 11Y, 11M, 11C, and 11K (which may sometimes be collectively referred to as "image forming units 11"), which are examples of toner-image forming units arranged parallel to each other at specific pitch. Each of the image forming units 11 includes a photoconductor drum 12 that forms an electrostatic latent image and bears a toner image, a charging device 13 that electrostatically charges the surface of the photoconductor drum 12 with a predetermined potential, a light-emitting-diode (LED) print head 14 that exposes the photoconductor drum 12 electrostatically charged by the charging device 13 to light based on image data of the corresponding color, a developing device 15 that develops the electrostatic latent image formed on the photoconductor drum 12, and a drum cleaner 16 that cleans the surface of the photoconductor drum 12 after a transfer process.

The image forming units 11 have substantially identical configurations except for toners accommodated in the developing devices 15, and respectively form yellow (Y), magenta (M), cyan (C), and black (K) toner images.

The image forming section 10 also includes an intermediate transfer belt 20 onto which the toner images formed on the photoconductor drums 12 of the respective image forming units 11 are superimposed and transferred, and first-transfer rollers 21 that sequentially transfer (first-transfer) the toner images formed at the image forming units 11 onto the intermediate transfer belt 20. Furthermore, the image forming section 10 includes a second-transfer roller 22 that collectively transfers (second-transfers) the toner images superimposed and transferred on the intermediate transfer belt 20 onto a sheet P, which is a recording medium (recording paper), and a fixing unit 60 as an example of a fixing device or a fixing unit that fixes the second-transferred toner images onto the sheet P. In the image forming apparatus 1 according to the first exemplary embodiment, the intermediate transfer belt 20, the first-transfer rollers 21, and the second-transfer roller 22 constitute a transfer unit.

In the image forming apparatus 1 according to the first exemplary embodiment, an image forming process is performed in the following manner under the control of the controller 31. Specifically, image data from the PC 3 or the scanner 4 is received by the communication section 32 and undergoes predetermined image processing performed by the image processor 33 so as to become image data for the respective colors, which are then transmitted to the respective image forming units 11. Then, for example, in the image forming unit 11K that forms a black (K) toner image, the photoconductor drum 12 is electrostatically charged with a predetermined potential by the charging device 13 while the photoconductor drum 12 rotates in a direction indicated by an arrow A. Based on the K-color image data transmitted from the image processor 33, the LED print head 14 performs scan exposure on the photoconductor drum 12. Thus, an electrostatic latent image related to a K-color image is formed on the photoconductor drum 12. The K-color electrostatic latent image formed on the photoconductor drum 12 is developed by the developing device 15, so that a K-color toner image is formed on the photoconductor drum 12. Likewise, yellow (Y), magenta (M), and cyan (C) toner images are formed in the image forming units 11Y, 11M, and 11C, respectively.

The toner images formed on the photoconductor drums 12 in the respective image forming units 11 are sequentially electrostatically-transferred (first-transferred) by the first-transfer rollers 21 onto the intermediate transfer belt 20 moving in a direction indicated by an arrow B, whereby superimposed toner images of the respective colors are formed. As the intermediate transfer belt 20 moves, the superimposed toner images on the intermediate transfer belt 20 are transported to a region (second-transfer portion T) where the second-transfer roller 22 is disposed. In accordance with the timing at which the superimposed toner images are transported to the second-transfer portion T, a sheet supporter 40 feeds a sheet P to the second-transfer portion T. Then, the superimposed toner images are collectively electrostatically-transferred (second-transferred) onto the transported sheet P by a transfer electric field formed in the second-transfer portion T by the second-transfer roller 22.

Subsequently, the sheet P having the superimposed toner images electrostatically-transferred thereon is transported to the fixing unit 60. The toner images on the sheet P transported to the fixing unit 60 receive heat and pressure from the fixing unit 60 so as to become fixed onto the sheet P. Then, the sheet P having the fixed image formed thereon is transported to a sheet load section 45 provided at an output section of the image forming apparatus 1.

The toners (first-transfer residual toners) adhered to the photoconductor drums 12 after the first-transfer process and the toners (second-transfer residual toners) adhered to the intermediate transfer belt 20 after the second-transfer process are removed therefrom by the drum cleaners 16 and a belt cleaner 25, respectively.

The image forming process in the image forming apparatus 1 is performed in this manner in repeated cycles for the number of print sheets.

Configuration of Fixing Unit

Next, the fixing unit 60 according to the first exemplary embodiment will be described.

Figure 2:
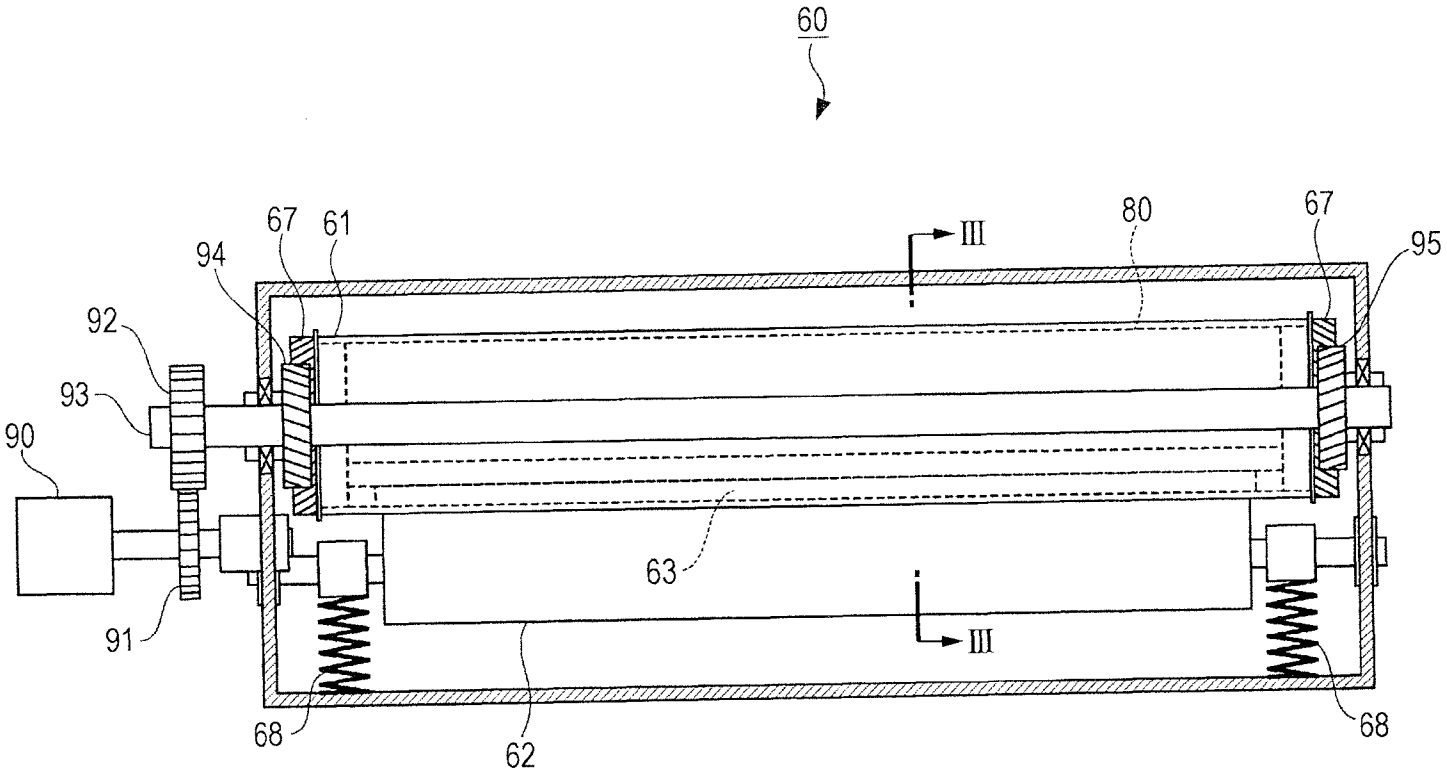
FIG. 2 illustrates the configuration of the fixing unit according to the first exemplary embodiment.
Figure 3:
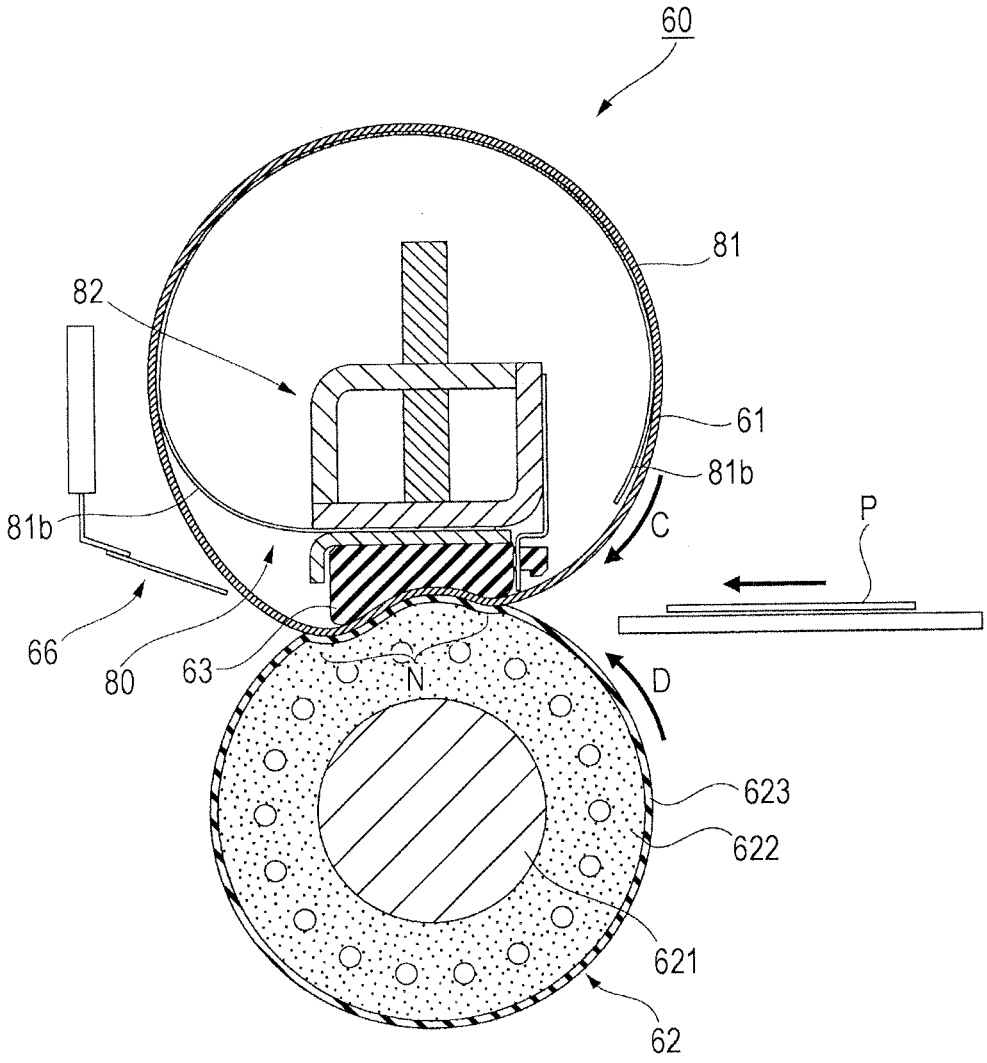
FIG. 3 illustrates the configuration of the fixing unit according to the first exemplary embodiment.

FIGS. 2 and 3 illustrate the configuration of the fixing unit 60 according to the first exemplary embodiment. Specifically, FIG. 2 is a front view and FIG. 3 is a cross-sectional view taken along line III-III in FIG. 2.

As shown in the cross-sectional view in FIG. 3, the fixing unit 60 includes a heater unit 80 as a heating source, a fixing belt 61 as an example of a heated member or a fixing member that fixes a toner image by being heated by the heater unit 80, a pressure roller 62 disposed facing the outer periphery of the fixing belt 61, and a press pad 63 that is pressed by the pressure roller 62 via the fixing belt 61.

Furthermore, the fixing unit 60 includes a detachment assisting member 66 that assists in detaching a sheet P from the fixing belt 61.

As shown in, for example, FIGS. 2 and 3, in the following description, a rotation-axis direction of the fixing belt 61 in the fixing unit 60 will be defined as an X direction, a moving direction (i.e., sheet transport direction) of the fixing belt 61 at a nip N, which will be described later, will be defined as a Y direction, and a direction orthogonal to both the X and Y directions will be defined as a Z direction.

Fixing Belt

Figure 4:
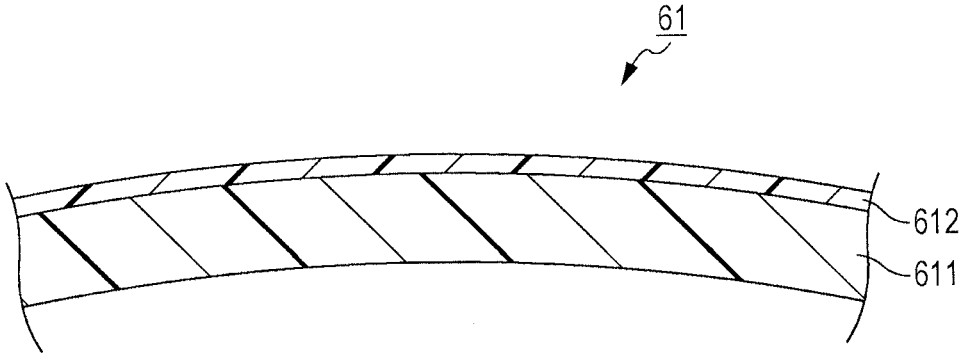
FIG. 4 is a cross-sectional view illustrating a layer configuration of a fixing belt.

The fixing belt 61 is formed of an endless belt member that is cylindrical in its original form and has, for example, a diameter of 30 mm and a length of 300 mm in the width direction when in its original form (i.e., cylindrical shape). Furthermore, as shown in FIG. 4 (which is a cross-sectional view illustrating a layer configuration of the fixing belt 61), the fixing belt 61 is a belt member constituted of a base layer 611 and a release layer 612 that covers the base layer 611.

The base layer 611 is formed of a heat-resistant sheet-shaped member that provides mechanical strength to the entire fixing belt 61.

For example, a polyimide resin sheet having a thickness ranging between 60 μm and 200 μm is used as the base layer 611. In order to make temperature distribution of the fixing belt 61 more uniform, a thermally-conductive filler composed of, for example, an aluminum oxide may be contained within the polyimide resin sheet.

The release layer 612 is composed of a material with high releasability since it directly comes into contact with an unfixed toner image on a sheet P. For example, a tetrafluoroethylene-perfluoroalkylvinylether polymer (PFA), polytetrafluoroethylene (PTFE), a silicone copolymer, or a composite layer of these materials is used. With regard to the thickness of the release layer 612, if the release layer 612 is too thin, the release layer 612 is insufficient in terms of abrasion resistance and may shorten the lifespan of the fixing belt 61. If the release layer 612 is too thick, the heat capacity of the fixing belt 61 becomes too large, resulting in a longer warmup time. In view of the balance between abrasion resistance and heat capacity, a desired range for the thickness of the release layer 612 is between 1 μm and 50 μm.

If a color image is to be formed at the image forming section 10 (see FIG. 1), for example, an elastic layer composed of a heat-resistant elastic material, such as silicone rubber, is desirably provided between the base layer 611 and the release layer 612 of the fixing belt 61.

Drive Mechanism of Fixing Belt

Next, a drive mechanism of the fixing belt 61 will be described.

As shown in the plan view in FIG. 2, end cap members 67 that rotationally drive the fixing belt 61 in the circumferential direction while maintaining the cross-sectional shape at the opposite ends of the fixing belt 61 in a circular shape are fixed to opposite axial ends (in the X direction) of a support frame 82 (see FIG. 3), which will be described later, of the heater unit 80. The fixing belt 61 directly receives the rotational driving force from the opposite ends via the end cap members 67 so as to rotate in a direction indicated by an arrow C in FIG. 3 at a processing speed of, for example, 140 mm/s.

The end cap members 67 are composed of a so-called engineering plastic material having high mechanical strength and high heat resisting properties. Suitable examples include phenolic resin, polyimide resin, polyamide resin, polyamide-imide resin, polyether-ether-ketone (PEEK) resin, polyether-sulfone (PES) resin, polyphenylene-sulfide (PPS) resin, and liquid crystal polymer (LCP) resin.

As shown in FIG. 2, in the fixing unit 60, a rotational driving force from a drive motor 90 is transmitted to a shaft 93 via transmission gears 91 and 92, and is then transmitted to the end cap members 67 via transmission gears 94 and 95 coupled to the shaft 93. Thus, the rotational driving force is transmitted from the end cap members 67 to the fixing belt 61, so that the end cap members 67 and the fixing belt 61 are rotationally driven as a single unit.

Pressure Roller

Referring back to FIG. 3, the pressure roller 62 is disposed facing the fixing belt 61 and rotates in a direction indicated by an arrow D in FIG. 3 at a processing speed of, for example, 140 mm/s by being driven by the fixing belt 61. Then, in a state where the fixing belt 61 is nipped between the pressure roller 62 and the press pad 63, a nip N is formed. By making a sheet P bearing an unfixed toner image pass through this nip N, the unfixed toner image receives heat and pressure so as to become fixed onto the sheet P.

The pressure roller 62 is formed by laminating a solid aluminum core (columnar cored bar) 621, a heat-resistant elastic layer 622, and a release layer 623. The core 621 has a diameter of, for example, 18 mm. The heat-resistant elastic layer 622 covers the outer peripheral surface of the core 621 and is formed of, for example, silicone sponge with a thickness of 5 mm. The release layer 623 is formed of, for example, a heat-resistant rubber coating or a heat-resistant resin coating, such as PFA with carbon blended therein, having a thickness of 50 μm. The pressure roller 62 is pressed against the press pad 63 via the fixing belt 61 by press springs 68 (see FIG. 2) with a load of, for example, 25 kgf.

Press Pad

The press pad 63 is a block member composed of a rigid material, such as silicone rubber or fluorocarbon rubber, and is substantially circular-arc-shaped in cross section. The press pad 63 is supported within the fixing belt 61 by the support frame 82, which will be described later, of the heater unit 80. In a region where the pressure roller 62 is in pressure contact with the fixing belt 61, the press pad 63 is securely disposed over the entire region in the X direction. The press pad 63 is installed so as to uniformly press against a predetermined width region of the pressure roller 62 with a predetermined load (e.g., an average load of 10 kgf) via the fixing belt 61, thereby forming the nip N.

Configuration of Heater Unit

Figure 5A:
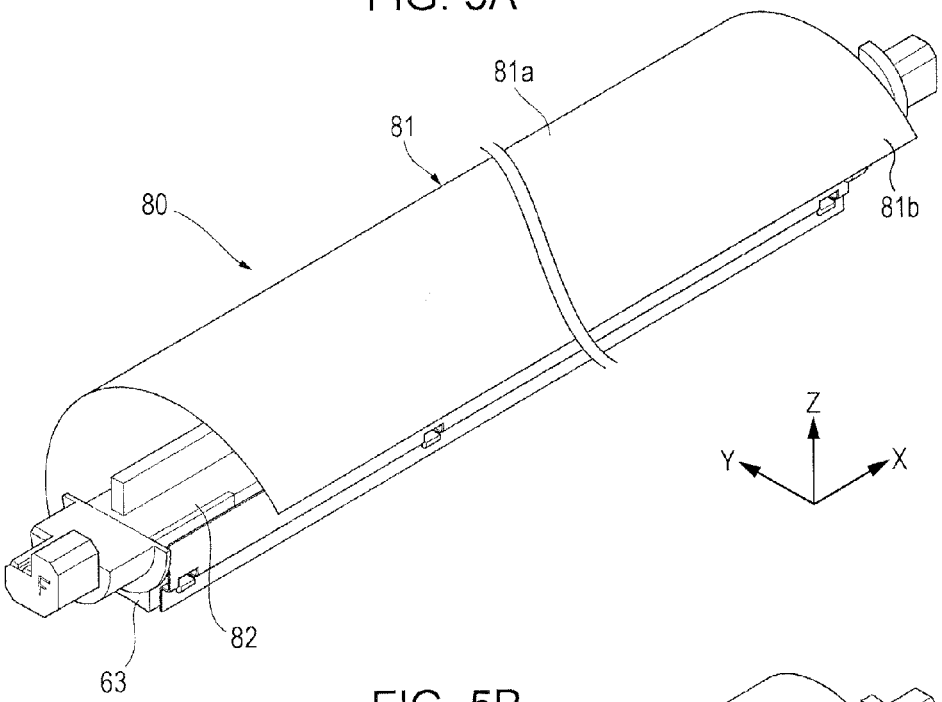
FIGS. 5A and 5B illustrate the configuration of a heater unit according to the first exemplary embodiment.
Figure 5B:
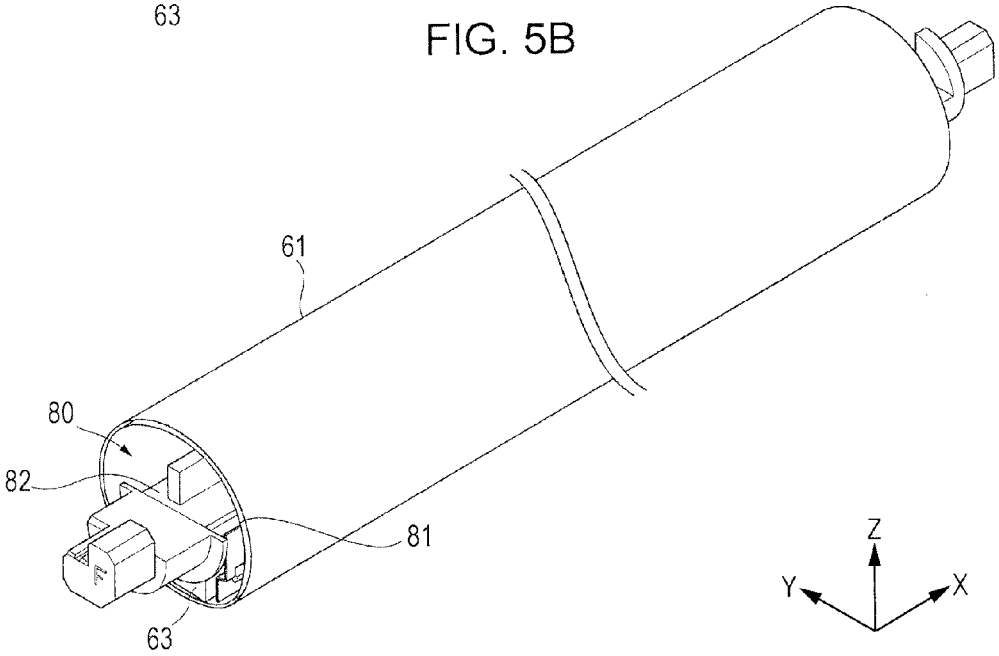

FIGS. 5A and 5B illustrate the configuration of the heater unit 80 according to the first exemplary embodiment. Specifically, FIG. 5A is a perspective view of the heater unit 80 when detached from the inner periphery of the fixing belt 61, and FIG. 5B is a perspective view of the fixing belt 61 and the heater unit 80 when attached to the inner periphery of the fixing belt 61.

The heater unit 80 shown in the drawings includes a heater 81 as a heat-generating source and the support frame 82 that supports the heater 81 and the aforementioned press pad 63.

In the first exemplary embodiment, the heater 81 functions as an example of a heating member that heats the fixing belt 61 from the inner peripheral side of the fixing belt 61 (see FIG. 3).

Figure 6A:
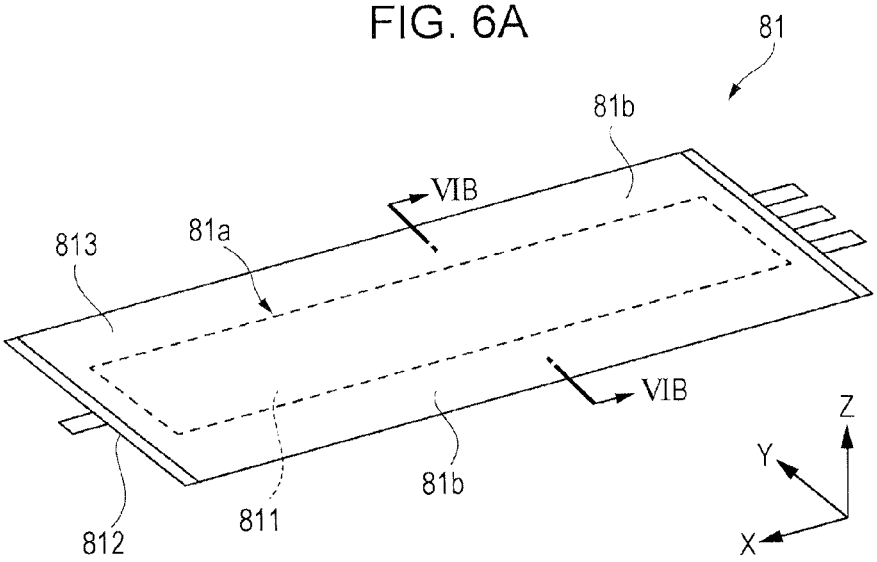
FIGS. 6A and 6B illustrate the configuration of a heater.
Figure 6B:
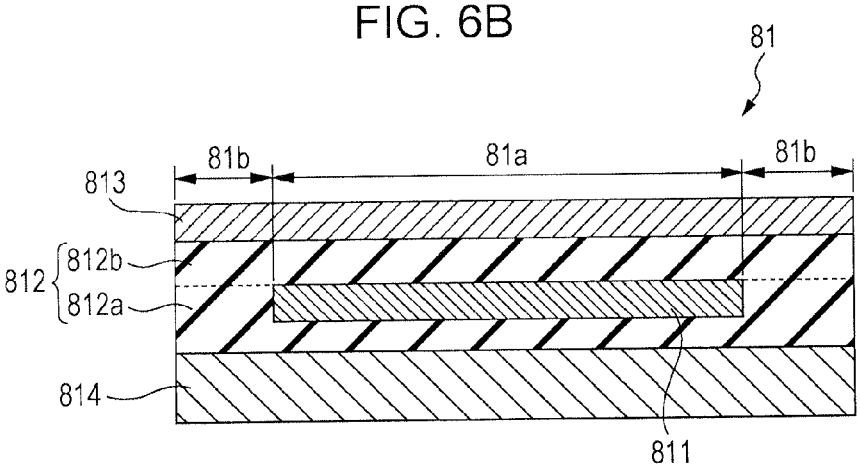

FIGS. 6A and 6B illustrate the configuration of the heater 81.

The heater 81 has a shape of a sheet that is flexible in its entirety. In actual use, in order to dispose the heater 81 in contact with the inner peripheral surface of the fixing belt 61 (see FIG. 3), the heater 81 is bent into a circular arc shape so as to conform with the inner peripheral surface of the fixing belt 61, as shown in FIGS. 3, 5A, and 5B. However, in order to provide an easier understanding, FIGS. 6A and 6B illustrate the heater 81 in a planar state prior to being bent into a circular arc shape. FIG. 6A is a perspective view of the heater 81, and FIG. 6B is a cross-sectional view of the heater 81 taken along line VIB-VIB.

As shown in FIGS. 6A and 6B, the heater 81 has a structure in which a heat-generating layer 811 is enclosed within an insulation layer 812. Furthermore, a side (i.e., upper side in FIG. 6B) of the heater 81 that comes into contact with the inner peripheral surface of the fixing belt 61 is provided with a support metallic layer 813 as an example of a metallic layer formed of metallic foil. Moreover, a side (i.e., lower side in FIG. 6B) of the heater 81 opposite the support metallic layer 813 is provided with a thermal-diffusion metallic layer 814 as an example of a thermally conductive layer formed of metallic foil different from that of the support metallic layer 813. In other words, in the heater 81 according to the first exemplary embodiment, the support metallic layer 813 is laminated on one of the surfaces of the insulation layer 812, and the thermal-diffusion metallic layer 814 is laminated on the other surface of the insulation layer 812.

Furthermore, as shown in FIG. 6A, the heater 81 prior to being bent into a circular-arc shape is rectangular in its entirety. In other words, the heater 81 according to the first exemplary embodiment has two opposite lengthwise edges and two opposite widthwise edges intersecting with the lengthwise edges. The direction in which the lengthwise edges of the heater 81 extend (which may sometimes be referred to as "longitudinal direction" hereinafter) corresponds to the rotation-axis direction (i.e., the X direction) of the fixing belt 61.

As shown in FIG. 6A, in the heater 81 according to the first exemplary embodiment, a heat-generating region 81*a* where the heat-generating layer 811 is provided is formed in the longitudinal direction. Moreover, non-heat-generating regions 81*b* where the heat-generating layer 811 is not provided are formed along the lengthwise edges of the heater 81 and opposite each other with the heat-generating region 81*a* interposed therebetween.

The heat-generating layer 811 is composed of an electrically-conductive heat-generating material that generates heat by being supplied with electricity. In the first exemplary embodiment, the heat-generating layer 811 is formed of, for example, stainless steel foil with a thickness of 30 μm. Examples of stainless steel foil that may be used as the heat-generating layer 811 include steel use stainless (SUS) 430 and SUS 330. Furthermore, the heat-generating layer 811 is configured to generate heat more uniformly by having a predetermined pattern.

Figure 7A:
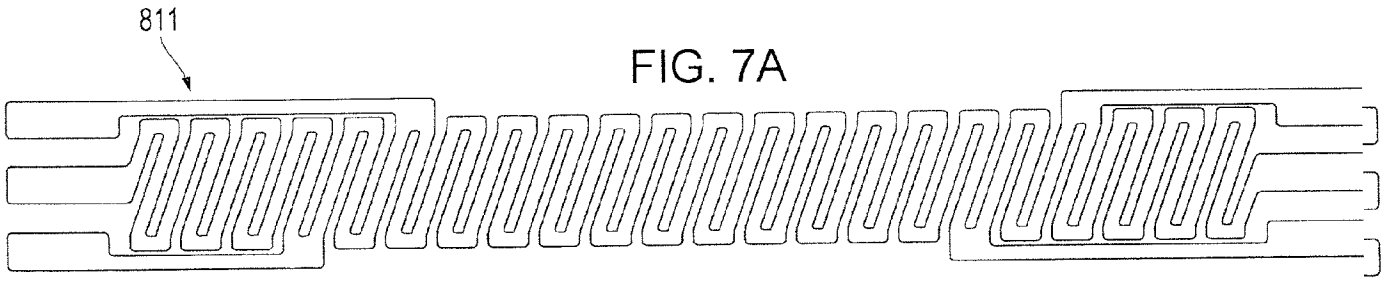
FIGS. 7A to 7C illustrate examples of patterns of a heat-generating layer.
Figure 7B:
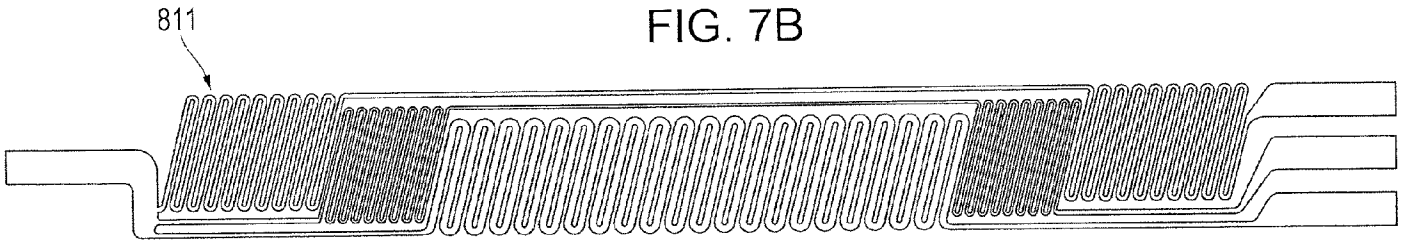
Figure 7C:
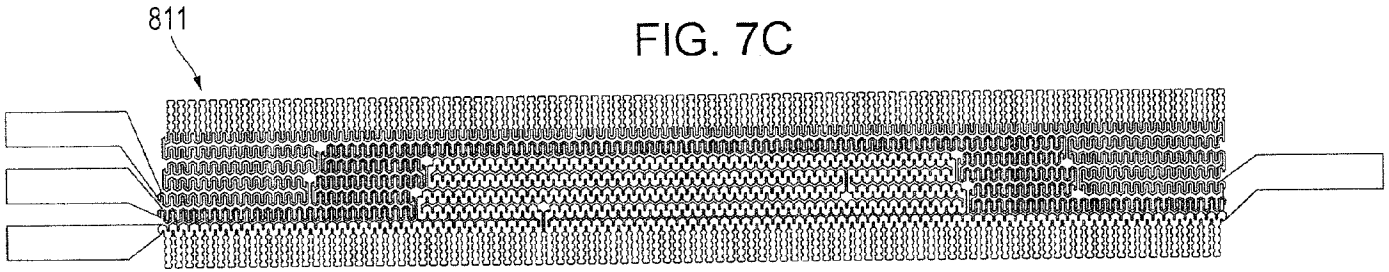

FIGS. 7A to 7C illustrate examples of patterns of the heat-generating layer 811.

The patterns of the heat-generating layer 811 shown in FIGS. 7A and 7B are formed by continuously connecting U-shaped basic patterns, each having a circular-arc curved segment and linearly-extending segments. Specifically, the pattern shown in FIG. 7A is formed by continuously connecting U-shaped basic patterns that have identical sizes. The pattern shown in FIG. 7B is formed by combining multiple types of U-shaped basic patterns of different sizes.

In each of the patterns of the heat-generating layer 811 shown in FIGS. 7A and 7B, the segments constituting each U-shaped basic pattern are tilted relative to the lateral direction of the heater 81 (see FIGS. 6A and 6B).

The pattern of the heat-generating layer 811 shown in FIG. 7C has linearly-extending segments in which the pattern extends linearly, and curved segments in which the pattern is curved. The edges of two linearly-extending segments and the edge of one curved segment constitute a part of a regular hexagon. In the heat-generating layer 811 shown in FIG. 7C, the linearly-extending segments and the curved segments are continuously connected such that the edges thereof form an obtuse angle.

The pattern of the heat-generating layer 811 may be selected in accordance with the materials of, for example, the fixing belt 61 and the heater 81, the fixation temperature, and so on, and is not limited to those shown in FIGS. 7A to 7C.

Referring back to FIGS. 6A and 6B, the insulation layer 812 is for insulating the heat-generating layer 811 and also for protecting the heat-generating layer 811 so as to, for example, prevent it from being bent. In the first exemplary embodiment, the insulation layer 812 has a two-layer structure including an insulation layer 812*a* and an insulation layer 812*b*. The heat-generating layer 811 is enclosed within the insulation layer 812 by sandwiching the heat-generating layer 811 between the insulation layer 812*a* and the insulation layer 812*b* and performing thermo-compression bonding thereon. Therefore, in this case, the insulation layer 812*a* and the insulation layer 812*b* are bonded to each other into a single unit.

The insulation layers 812*a* and 812*b* are each composed of a material having insulating properties as well as high heat resisting properties. In the first exemplary embodiment, the insulation layer 812*a* is composed of, for example, thermosetting polyimide with a thickness ranging between 25 μm and 50 μm. The insulation layer 812*b* is composed of, for example, thermoplastic polyimide with a thickness ranging between 25 μm and 50 μm.

Other examples that may be used as the insulation layer 812 include a vapor deposited film composed of an insulating material and a thin ceramic film.

The support metallic layer 813 is configured to maintain the heater 81 in a curved shape and also to generate an elastic restoring force, which will be described below, in the heater 81. Furthermore, the support metallic layer 813 also has a function for diffusing the heat generated from the heat-generating layer 811 in a planar direction of the heater 81.

The term "elastic restoring force" refers to an elastic force generated in an elastic body that makes the elastic body restore its initial state when a force that displaces the elastic body is applied to the elastic body in a state (i.e., initial state) where there is no force acting on the elastic body from an external source.

The support metallic layer 813 according to the first exemplary embodiment is composed of a metallic material, such as elemental metal or an alloy, having higher thermal conductivity than the insulation layer 812 and higher rigidity than the insulation layer 812 and the thermal-diffusion metallic layer 814. In this example, the support metallic layer 813 according to the first exemplary embodiment is composed of stainless steel foil (SUS 330) with a thickness of 30 μm.

Although the thickness of the support metallic layer 813 varies depending on the material of the support metallic layer 813 as well as, for example, the materials and the thicknesses of the heat-generating layer 811, the insulation layer 812, and the thermal-diffusion metallic layer 814, the thickness of the support metallic layer 813 according to the first exemplary embodiment is set such that an elastic restoring force is generated in the entire heater 81 when the heater 81 is elastically deformed into a curved shape.

The thermal-diffusion metallic layer 814 is provided for diffusing the heat generated from the heat-generating layer 811 in the planar direction of the heater 81 so as to suppress a temperature variation in the heater 81 in the planar direction thereof.

The thermal-diffusion metallic layer 814 according to the first exemplary embodiment is composed of a metallic material, such as elemental metal or an alloy, having higher thermal conductivity than the insulation layer 812 and the support metallic layer 813. Moreover, the thermal-diffusion metallic layer 814 according to the first exemplary embodiment is composed of a metallic material having higher rigidity than the insulation layer 812. In this example, the thermal-diffusion metallic layer 814 is formed of copper foil with a thickness of 70 μm.

In the heater 81 according to the first exemplary embodiment, the support metallic layer 813 is joined to the insulation layer 812*b*, and the thermal-diffusion metallic layer 814 is joined to the insulation layer 812*a*. In actuality, when sandwiching the heat-generating layer 811 between the insulation layer 812*a* and the insulation layer 812*b* and performing thermo-compression bonding thereon, a process for bonding the support metallic layer 813 to the insulation layer 812*b* and a process for bonding the thermal-diffusion metallic layer 814 to the insulation layer 812*a* are also performed.

Then, the planar-shaped heater 81 having the support metallic layer 813, the insulation layer 812*b*, the heat-generating layer 811, the insulation layer 812*a*, and the thermal-diffusion metallic layer 814 laminated in that order is heated and cooled in a state where the heater 81 is curved to predetermined curvature. Consequently, as shown in FIG. 5A, a heater 81 having a curved shape even when not receiving an external force is obtained.

Detailed configurations of the support metallic layer 813 and the thermal-diffusion metallic layer 814 in the heater 81 and effects achieved by providing the support metallic layer 813 and the thermal-diffusion metallic layer 814 in the heater 81 will be described later.

Referring back to FIGS. 3, 5A, and 5B, in the heater 81 according to the first exemplary embodiment, one of the two non-heat-generating regions 81*b* formed in the longitudinal direction is attached to the support frame 82 in the longitudinal direction thereof.

Furthermore, as described above, the heater 81 according to the first exemplary embodiment has a curved shape in a state where it does not receive an external force (i.e., in a state where the heater unit 80 is detached from the inner periphery of the fixing belt 61). In this example, the curvature of the heater 81 curved in a state where it does not receive an external force is smaller than the curvature of the fixing belt 61. In other words, the radius of curvature of the curved heater 81 is larger than the radius of curvature of the inner peripheral surface of the fixing belt 61.

Furthermore, in a state where the heater unit 80 is detached from the inner periphery of the fixing belt 61, the other non-heat-generating region 81*b* of the heater 81 that is not attached to the support frame 82 is separated from the support frame 82 so as to be in a floating state, as shown in FIG. 5A.

In a state where the heater unit 80 is installed within the inner periphery of the fixing belt 61, the heater 81 is pressed against the inner peripheral surface of the fixing belt 61 and thus elastically deforms in conformity with the inner peripheral surface of the fixing belt 61 so that the curvature of the heater 81 increases. Thus, due to its own elastic restoring force, the heater 81 is pressed against the inner peripheral surface of the fixing belt 61.

In the first exemplary embodiment, the heater 81 is attached to the support frame 82 at one of the non-heat-generating regions 81*b* where the heat-generating layer 811 is not provided. In the heat-generating region 81*a* where the heat-generating layer 811 is provided, the heater 81 is not in contact with members other than the fixing belt 61. Specifically, in FIG. 5A, an upper surface (i.e., the support metallic layer 813, see FIG. 6B) of the heater 81 comes into contact with the fixing belt 61, whereas a lower surface (i.e., the thermal-diffusion metallic layer 814, see FIG. 6B) of the heater 81 does not come into contact with other members so that the lower side of the heater 81 is in a hollow state. Therefore, for example, when the image forming apparatus 1 (see FIG. 1) is turned on and the fixing unit 60 (see FIG. 1) is activated, or when the fixing unit 60 in a dormant state is reactivated, the fixing belt 61 is increased in temperature more quickly.

Problem Occurring in Heater in Related Art

In a fixing device that heats a fixing member by bringing a heating member into contact with the fixing member, the heat capacity of the heating member is sometimes reduced by, for example, using a thin-plate-shaped heating member so as to shorten the time it takes for the heating member to heat the fixing member. Moreover, in order to enhance contactability of the heating member relative to the fixing member, for example, a configuration in which the thin-plate-shaped heating member is made elastically deformable so as to bring the heating member into contact with the fixing member by an elastic restoring force is sometimes employed.

In a fixing unit that heats a fixing belt by bringing a sheet-shaped heater (heating member) into contact with the inner peripheral surface of the fixing belt, conduction of heat from the fixing belt to a sheet is difficult in a non-heat-generating region through which the sheet is not transported, sometimes resulting in an excessive temperature increase in the heater and the fixing belt. In particular, in the case where the heat capacity of the heater is reduced by employing a thin-plate-shaped heater, the heater tends to increase in temperature in the non-heat-generating region.

Figure 8A:
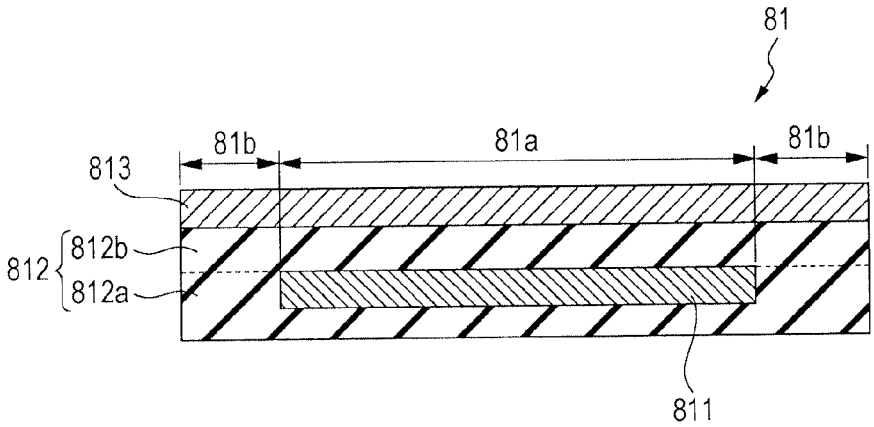
FIG. 8A RELATED ART
FIG. 8A is a cross-sectional view illustrating a layer configuration of a heater in the related art.
Figure 8B:
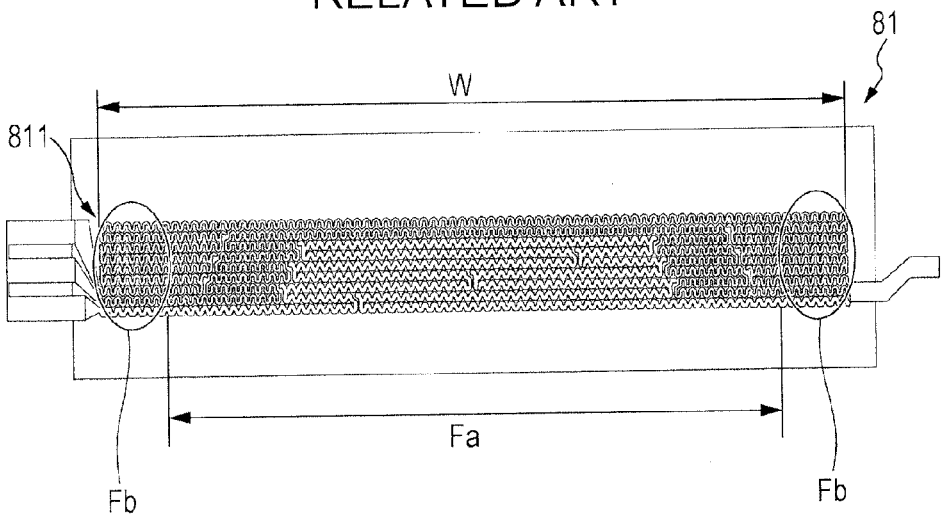
FIG. 8B RELATED ART
FIG. 8B illustrates a relative positional relationship between a heat-generating layer in the heater and a sheet width when a sheet is transported to a fixing unit.

FIG. 8A is a cross-sectional view illustrating a layer configuration of a heater 81 in the related art, and FIG. 8B illustrates a relative positional relationship between a heat-generating layer 811 in the heater 81 and a sheet width when a sheet is transported to the fixing unit 60.

In FIGS. 8A and 8B, components similar to those in the first exemplary embodiment described above are given the same reference numerals as in the first exemplary embodiment.

As shown in FIG. 8A, the heater 81 in the related art has a structure in which the heat-generating layer 811 is enclosed within an insulation layer 812. As shown in FIG. 8B, the heat-generating layer 811 of the heater 81 in the related art is similar to the heat-generating layer 811 according to the first exemplary embodiment in having a pattern with curved segments.

Furthermore, in the heater 81 in the related art, a side thereof that comes into contact with the inner peripheral surface of the fixing belt 61 is provided with a support metallic layer 813 formed of, for example, stainless steel foil with a thickness of 30 μm, but a component corresponding to the thermal-diffusion metallic layer 814 in the first exemplary embodiment is not provided.

Although not shown, the heater 81 is similar to the heater 81 according to the first exemplary embodiment shown in, for example, FIG. 3 in that the heater 81 is curved into a circular-arc shape, is supported at a non-heat-generating region 81*b* extending in the longitudinal direction, and is in contact with the inner peripheral surface of the fixing belt 61 in the fixing unit 60 by an elastic restoring force.

Generally, in the fixing unit 60, a width W of the heat-generating layer 811 in the longitudinal direction is set to be larger than a sheet-passing region Fa where a sheet passes, as shown in FIG. 8B, so that a region where the fixing belt is insufficiently heated is not formed in the sheet-passing region Fa. The sheet-passing region Fa in FIG. 8B corresponds to a region of the nip N (see FIG. 3) through which a sheet of a maximum width (e.g., a B4-size sheet with a longitudinal width of 257 mm) transported to the fixing unit 60 passes. Regions located closer to the edges relative to the sheet passing region Fa and through which a sheet does not pass are non-sheet-passing regions Fb. In this example, a sheet transporting process is performed with reference to a center position.

In a case where sheets are successively transported to the nip N (see FIG. 3) of the fixing unit 60, the heat for the fixing process is consumed in the sheet-passing region Fa where the sheets pass, so that the heat is conducted from the fixing belt 61 to the sheets. Therefore, temperature adjustment control based on a preset fixation temperature is performed by the controller 31 (see FIG. 1), so that the temperatures of the heater 81 and the fixing belt 61 in the sheet-passing region Fa are maintained within a temperature range that is lower than or equal to a predetermined upper limit temperature.

Since the sheets transported to the nip N do not pass through the non-sheet-passing regions Fb, the heat for the fixing process is less likely to be consumed therein. Specifically, in the non-sheet-passing regions Fb, the heat from the fixing belt 61 is less likely to be conducted to the sheets, so that the temperatures of the heater 81 and the fixing belt 61 in the non-sheet-passing regions Fb tend to increase to temperatures higher than the preset fixation temperature.

Figure 9:
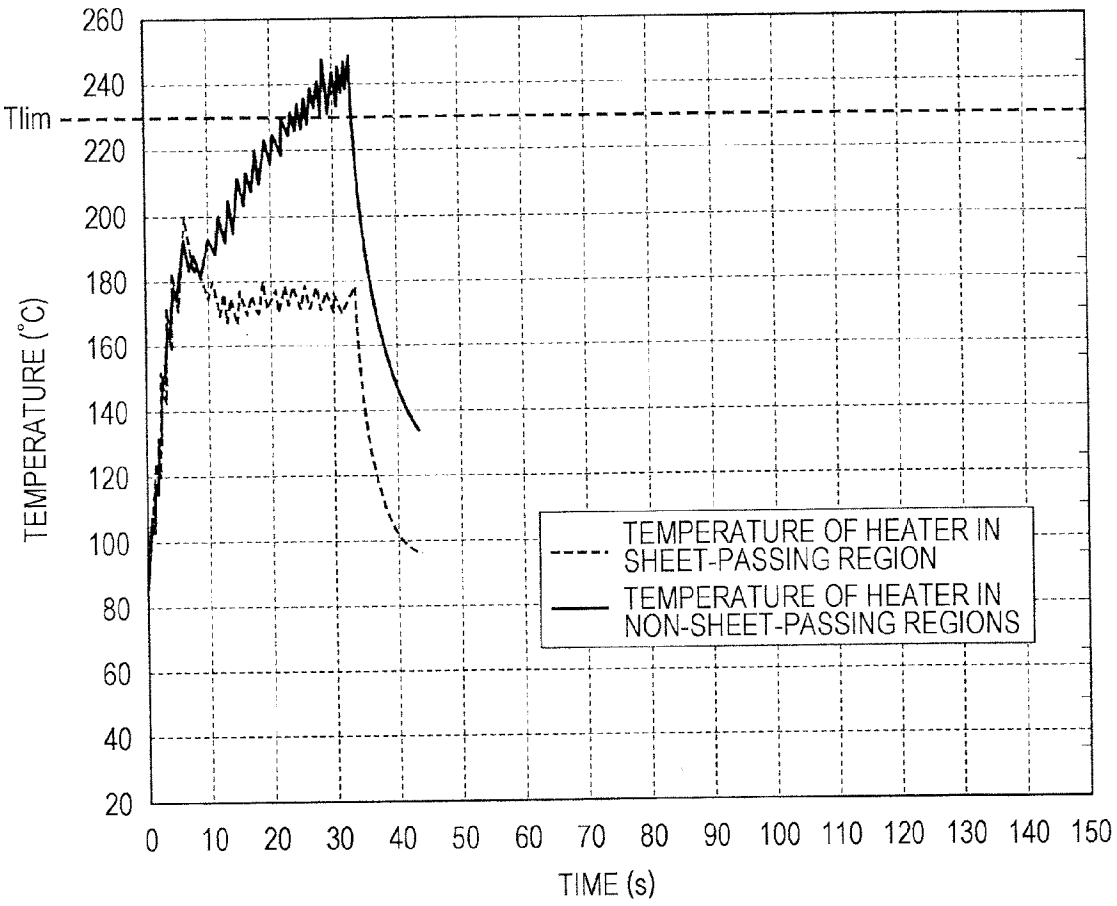
FIG. 9 RELATED ART
FIG. 9 illustrates a temperature change in the heater in the fixing unit equipped with the heater in the related art.

FIG. 9 illustrates a temperature change in the heater 81 in the fixing unit 60 equipped with the heater 81 in the related art.

As shown in FIG. 9, in the fixing unit 60 equipped with the heater 81 in the related art, the temperature in the non-sheet-passing regions Fb of the heater 81 reaches a predetermined upper limit temperature Tlim at a time point when 25 sheets have been transported (i.e., elapsed time of 30 seconds). In this example, the upper limit temperature Tlim is set to 230° C., which is a heat-resistant temperature of polyimide constituting the base layer 611 (see FIG. 4) of the fixing belt 61. In the fixing unit 60 equipped with the heater 81 in the related art, when sheets are successively transported thereafter, the temperatures of the heater 81 and the fixing belt 61 in the non-sheet-passing regions Fb exceed the heat-resistant temperature of the fixing belt 61 (i.e., the base layer 611), possibly damaging the fixing belt 61.

Figure 10A:
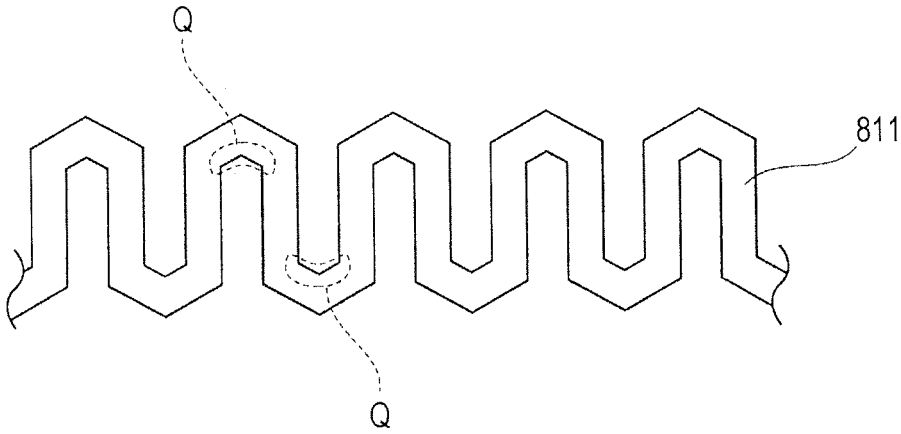
FIG. 10A RELATED ART
FIGS. 10A and 10B illustrate a state where electricity is applied to the heat-generating layer of the heater in the related art.
Figure 10B:
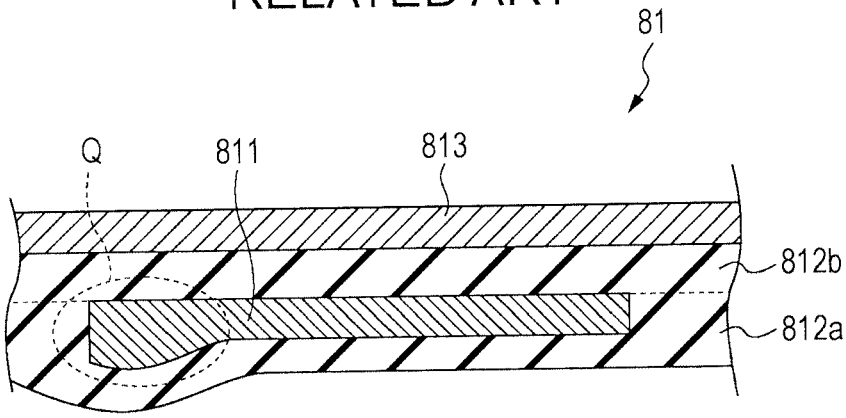
FIG. 10B RELATED ART

In the heater 81 in the related art, if the pattern of the heat-generating layer 811 has curved segments, there is a possibility that delamination may occur between the layers constituting the heater 81 due to a variation in heat generated in the heat-generating layer 811 when electricity is applied to the heat-generating layer 811. FIGS. 10A and 10B illustrate a state where electricity is applied to the heat-generating layer 811 of the heater 81 in the related art. Specifically, FIG. 10A is an enlarged view of the heat-generating layer 811 of the heater 81 as viewed from above, and FIG. 10B is a side view of the heater 81.

In detail, when electricity is applied to the heat-generating layer 811 for heating the fixing belt 61, the electric current first flows along the shortest path in the pattern formed in the heat-generating layer 811. In the heat-generating layer 811 having curved segments, the electric current flows through the inner periphery of each curved segment denoted by reference character Q in FIG. 10A, so that heat is generated first at the inner periphery of the curved segment. As a result, the inner periphery increases in temperature prior to the outer periphery, so that thermal expansion occurs in the inner periphery.

Since the insulation layer 812 normally has lower rigidity and higher deformability than the heat-generating layer 811, when thermal expansion occurs in the curved segments of the heat-generating layer 811, the insulation layer 812 deforms so as to protrude toward the side at which the support metallic layer 813 is not provided, as shown in FIG. 10B. As a result, the heat-generating layer 811 in the heater 81 undulates, possibly causing, for example, delamination to occur between the heat-generating layer 811 and the insulation layer 812*b* and between the insulation layer 812*b* and the support metallic layer 813.

If delamination occurs between the layers in the heater 81, the heat generated in the heat-generating layer 811 is less likely to be conducted to the support metallic layer 813. As a result, an excessive temperature increase occurs especially at the curved segments of the heat-generating layer 811, possibly causing the heater 81 and the fixing belt 61 to become locally high in temperature and to become damaged.

Operation of Heater 81 According to First Exemplary Embodiment

As described above, in the heater 81 according to the first exemplary embodiment, the thermal-diffusion metallic layer 814 is formed of metallic foil (copper foil in this example) with higher thermal conductivity than the support metallic layer 813 and the insulation layer 812. Thus, when the heat from the heat-generating layer 811 is retained in the non-sheet-passing regions Fb (see FIG. 8B) of the heater 81 without being consumed therein, the heat is conducted from the non-sheet-passing regions Fb to the sheet-passing region Fa (see FIG. 8B) via the thermal-diffusion metallic layer 814.

Furthermore, the support metallic layer 813 is formed of metallic foil (stainless steel foil in this example) with lower thermal conductivity than the thermal-diffusion metallic layer 814 but higher thermal conductivity than the insulation layer 812.

Figure 11:
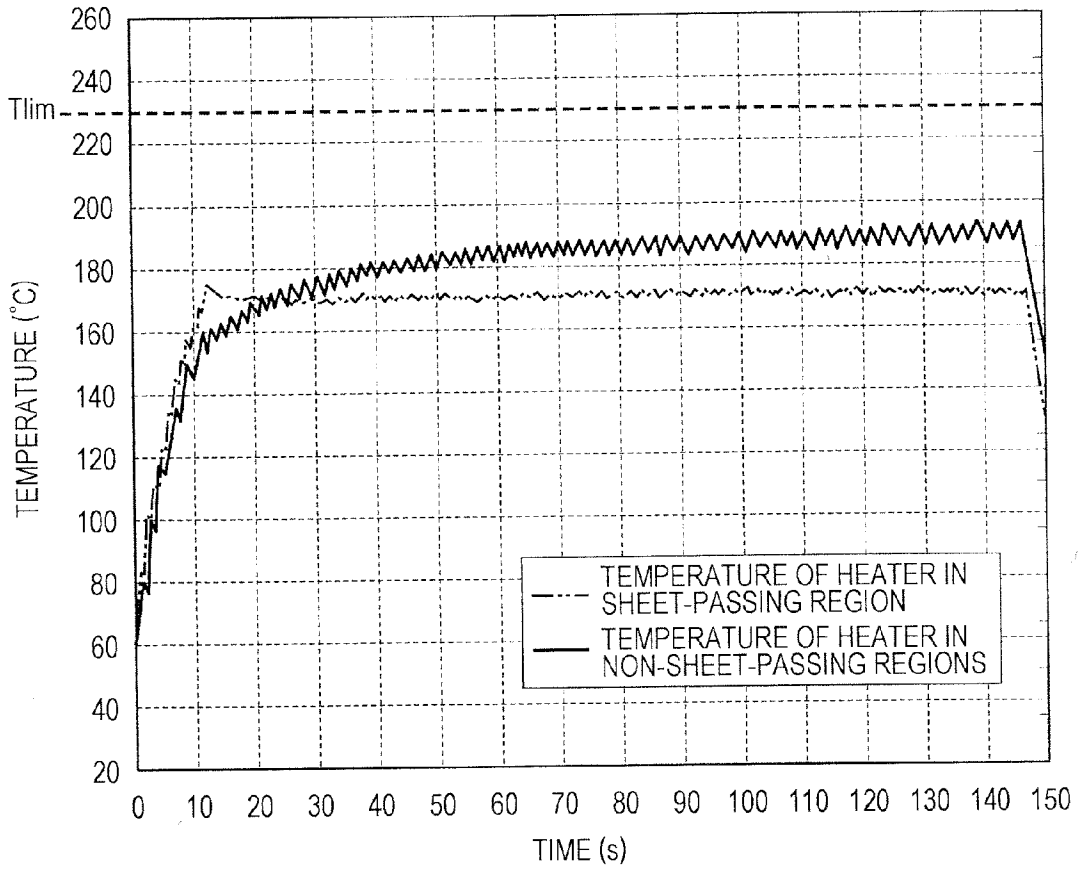
FIG. 11 illustrates a temperature change in the heater in the fixing unit equipped with the heater according to the first exemplary embodiment.

FIG. 11 illustrates a temperature change in the heater 81 in the fixing unit 60 equipped with the heater 81 according to the first exemplary embodiment.

As shown in FIG. 11, in the fixing unit 60 equipped with the heater 81 according to the first exemplary embodiment, an excessive temperature increase in the non-sheet-passing regions Fb is less likely to occur when sheets are successively transported, unlike the example shown in FIG. 9. Specifically, even at the time point corresponding to when the temperature in the non-sheet-passing regions Fb of the heater 81 in the related art reaches the upper limit temperature Tlim (i.e., when 25 sheets have been transported (i.e., elapsed time of 30 seconds)), the temperature in the non-sheet-passing regions Fb of the heater 81 is maintained below or equal to the upper limit temperature Tlim.

Furthermore, in the heater 81 according to the first exemplary embodiment, the heat-generating layer 811 and the insulation layer 812 are sandwiched between the support metallic layer 813 and the thermal-diffusion metallic layer 814, which have higher rigidity than the insulation layer 812. Thus, for example, even if the curved segments of the heat-generating layer 811 rapidly increase in temperature when electricity is applied to the heat-generating layer 811, the heat-generating layer 811 and the insulation layer 812 are pressed from opposite sides in the thickness direction by the support metallic layer 813 and the thermal-diffusion metallic layer 814.

Furthermore, in the heater 81 according to the first exemplary embodiment, the support metallic layer 813 is composed of a material, specifically, stainless steel (SUS 430 or SUS 330), with higher rigidity than the insulation layer 812 and the thermal-diffusion metallic layer 814. Generally, stainless steel has mechanical properties that hardly change in, for example, a temperature range lower than or equal to 500° C. Therefore, in the heater 81 according to the first exemplary embodiment, the support metallic layer 813 composed of stainless steel is provided so that even when the heater 81 is increased in temperature by causing the heat-generating layer 811 to generate heat, the elastic restoring force by the support metallic layer 813 is maintained.

For example, in a case where both the support metallic layer 813 and the thermal-diffusion metallic layer 814 are composed of stainless steel having high rigidity, the rigidity of the entire heater 81 tends to become higher, as compared with the first exemplary embodiment in which the thermal-diffusion metallic layer 814 is composed of a material (specifically, copper or aluminum) other than stainless steel. In this case, when the heater 81 is installed within the inner periphery of the fixing belt 61, the heater 81 becomes less elastically deformable, possibly resulting in insufficient pressing of the heater 81 against the inner peripheral surface of the fixing belt 61 by an elastic restoring force.

Furthermore, because stainless steel has lower thermal conductivity than, for example, copper and aluminum, if both the support metallic layer 813 and the thermal-diffusion metallic layer 814 are composed of stainless steel, the heater 81 and the fixing belt 61 tend to become locally high in temperature, as compared with the first exemplary embodiment in which the thermal-diffusion metallic layer 814 is composed of a material (specifically, copper or aluminum) other than stainless steel.

In a case where both the support metallic layer 813 and the thermal-diffusion metallic layer 814 are composed of, for example, copper or aluminum having lower rigidity than stainless steel, thermal conductivity improves in the planar direction of the heater 81, but the rigidity of the entire heater 81 tends to become lower. In this case, when the heater 81 is installed within the inner peripheral surface of the fixing belt 61 and is curved along the inner peripheral surface of the fixing belt 61, the elastic restoring force occurring in the heater 81 becomes smaller. As a result, the force by which the heater 81 is pressed against the inner peripheral surface of the fixing belt 61 becomes smaller, possibly resulting in lower contactability between the heater 81 and the inner peripheral surface of the fixing belt 61.

Since the heat-generating layer 811 has a pattern with curved segments, as described above, the heater 81 has a region where the heat-generating layer 811 is provided and a region where the heat-generating layer 811 is not provided. Therefore, in a case where the support metallic layer 813 does not exist or in a case where, for example, a material with lower rigidity than the thermal-diffusion metallic layer 814 is used as the support metallic layer 813, the heater 81 undulates due to the existence and nonexistence of the heat-generating layer 811, possibly resulting in formation of recesses and protrusions on the surface of the heater 81.

In the heater 81 according to the first exemplary embodiment, the support metallic layer 813 composed of SUS is provided at the side of the heater 81 that comes into contact with the inner peripheral surface of the fixing belt 61 (i.e., the outer peripheral side of the heater 81 when curved), and the thermal-diffusion metallic layer 814 composed of copper is provided at the side of the heater 81 that does not face the inner peripheral surface of the fixing belt 61 (i.e., the inner peripheral side of the heater 81 when curved). Alternatively, the positional relationship between the support metallic layer 813 and the thermal-diffusion metallic layer 814 may be inverted in the heater 81. Specifically, when the heater 81 is curved, the outer peripheral side thereof that comes into contact with the inner peripheral surface of the fixing belt 61 may be provided with the thermal-diffusion metallic layer 814, and the inner peripheral side of the heater 81 when curved may be provided with the support metallic layer 813.

Second Exemplary Embodiment

Figure 12:
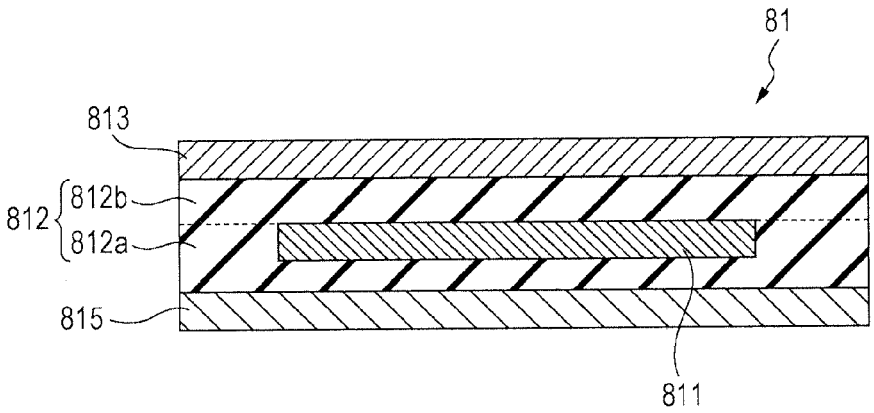
FIG. 12 illustrates the configuration of a heater according to a second exemplary embodiment.

Next, a second exemplary embodiment of the present invention will be described. FIG. 12 illustrates the configuration of a heater 81 according to the second exemplary embodiment and is a cross-sectional view of the heater 81 according to the second exemplary embodiment.

As shown in FIG. 12, the heater 81 according to the second exemplary embodiment is different from the heater 81 according to the first exemplary embodiment in that a thermal diffusion sheet 815 as another example of a thermal diffusion layer is laminated in place of the thermal-diffusion metallic layer 814. Specifically, the heater 81 according to the second exemplary embodiment has the thermal diffusion sheet 815 bonded to the insulation layer 812*a*.

The thermal diffusion sheet 815 is composed of a carbon-based material, such as a graphite sheet, having higher thermal conductivity in the planar direction and higher flexibility than the metallic foil, such as aluminum or copper, constituting the thermal-diffusion metallic layer 814 in the first exemplary embodiment. In the second exemplary embodiment, the thermal diffusion sheet 815 is formed of a graphite sheet with a thickness of 30 μm.

The heater 81 according to the second exemplary embodiment has the thermal diffusion sheet 815 formed of, for example, a graphite sheet.

Specifically, similar to the first exemplary embodiment, heat retained in the non-sheet-passing regions Fb (see FIG. 8B) of the heater 81 is conducted from the non-sheet-passing regions Fb to the sheet-passing region Fa (see FIG. 8B) via the thermal diffusion sheet 815.

Furthermore, as described above, the carbon-based material, such as a graphite sheet, constituting the thermal diffusion sheet 815 has high conductivity in the planar direction than the metallic foil, such as aluminum or copper, constituting the thermal-diffusion metallic layer 814 in the first exemplary embodiment. Thus, for example, even if the inner periphery of each curved segment of the heat-generating layer 811 rapidly increases in temperature when electricity is applied to the heat-generating layer 811, the heat generated at the inner periphery of the curved segment is quickly conducted in the planar direction by the thermal diffusion sheet 815.

Furthermore, because the thermal diffusion sheet 815 is composed of a carbon-based material, such as a graphite sheet, having higher flexibility than the support metallic layer 813, the thermal diffusion sheet 815 is less likely to have an effect on the elastic restoring force generated by the support metallic layer 813 of the curved heater 81.

Furthermore, since a graphite sheet normally has higher conductivity than metallic foil of the same thickness, the thickness of the thermal diffusion sheet 815 is reduced, as compared with the thickness of the thermal-diffusion metallic layer 814 in the heater 81 according to the first exemplary embodiment described above.

In the example shown in FIG. 12 in the second exemplary embodiment, the support metallic layer 813 is provided at the side of the heater 81 that comes into contact with the inner peripheral surface of the fixing belt 61 (i.e., the outer peripheral side of the heater 81 when curved), and the thermal diffusion sheet 815 is provided at the side of the heater 81 that does not face the inner peripheral surface of the fixing belt 61 (i.e., the inner peripheral side of the heater 81 when curved). Alternatively, the positional relationship between the support metallic layer 813 and the thermal diffusion sheet 815 may be inverted in the heater 81 according to the second exemplary embodiment.

Third Exemplary Embodiment

Figure 13A:
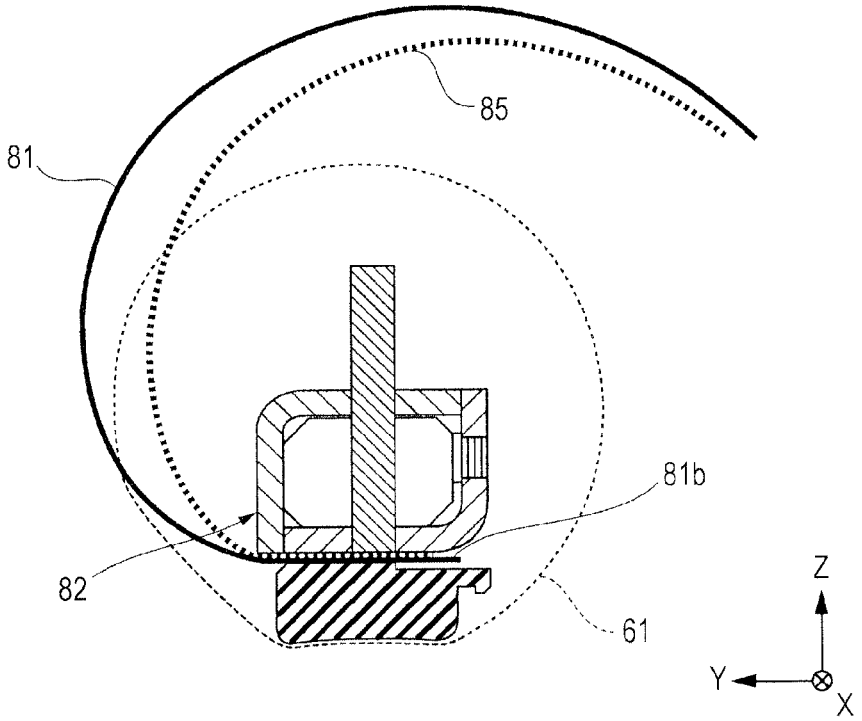
FIGS. 13A and 13B illustrate the configuration of a heater unit according to a third exemplary embodiment.
Figure 13B:
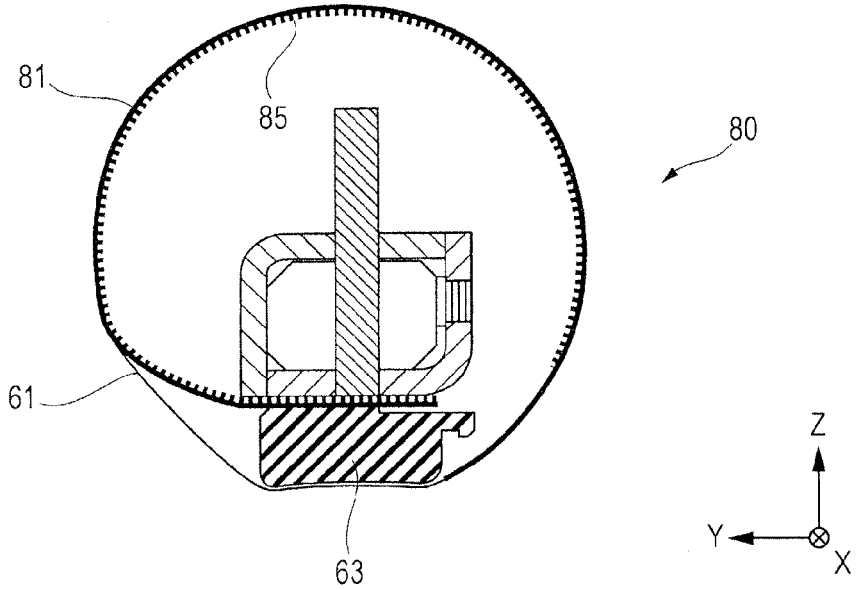

Next, a third exemplary embodiment of the present invention will be described. FIGS. 13A and 13B illustrate the configuration of a heater unit 80 according to the third exemplary embodiment. Specifically, FIG. 13A illustrates the heater unit 80 when detached from the inner periphery of the fixing belt 61, and FIG. 13B illustrates the heater unit 80 when installed within the inner periphery of the fixing belt 61.

The heater 81 according to the third exemplary embodiment does not have the thermal-diffusion metallic layer 814 of the heater 81 according to the first exemplary embodiment, but has a layer configuration similar to that of the heater 81 shown in FIG. 8A. Specifically, the heater 81 according to the third exemplary embodiment has a configuration obtained by laminating the heat-generating layer 811, the insulation layer 812 (812*a* and 812*b*), and the support metallic layer 813. As shown in FIGS. 13A and 13B, the heater unit 80 according to the third exemplary embodiment has a heat transfer member 85 as an example of a thermally conductive member provided separately from the heater 81.

The heat transfer member 85 according to the third exemplary embodiment is composed of metal, such as copper or aluminum, having higher thermal conductivity than the support metallic layer 813 composed of, for example, SUS and the insulation layer 812 composed of, for example, polyimide and having lower rigidity than the support metallic layer 813. In this example, the heat transfer member 85 is formed of copper foil with a thickness of 70 μm.

The heat transfer member 85 has flexibility in its entirety and is used in a state where it is curved in a circular-arc shape.

The heat transfer member 85 prior to being curved into a circular-arc shape is rectangular in its entirety and has two opposite lengthwise edges and two opposite widthwise edges intersecting with the lengthwise edges. With regard to the heat transfer member 85 according to the third exemplary embodiment, one of the two lengthwise edges is attached to the support frame 82.

More specifically, the heat transfer member 85 according to the third exemplary embodiment is positioned at the inner peripheral side relative to the heater 81 when the heater unit 80 is installed within the inner periphery of the fixing belt 61. In other words, the heat transfer member 85 according to the third exemplary embodiment is attached so as to face the insulation layer 812*a* (see FIG. 8A) of the heater 81.

Furthermore, the heat transfer member 85 has a curved shape when not in contact with, for example, the heater 81 (i.e., when not receiving an external force). Specifically, as shown in FIG. 13A, when the heater unit 80 is detached from the inner periphery of the fixing belt 61, the heat transfer member 85 is curved such that its curvature is smaller than that of the fixing belt 61 (i.e., its radius of curvature is larger than that of the fixing belt 61). In this example, the heat transfer member 85 is curved such that its curvature is larger than that of the curved heater 81.

When the heater unit 80 is installed within the inner periphery of the fixing belt 61, as shown in FIG. 13B, the heater 81 is pressed against the inner peripheral surface of the fixing belt 61, as in the first exemplary embodiment, whereby the heater 81 elastically deforms such that its curvature increases in conformity with the inner peripheral surface of the fixing belt 61.

Furthermore, in the third exemplary embodiment, when the heater unit 80 is installed within the inner periphery of the fixing belt 61, the heat transfer member 85 is pressed by the heater 81 deformed as a result of being pressed against the inner peripheral surface of the fixing belt 61. Thus, the heat transfer member 85 elastically deforms such that its curvature increases in conformity with the heater 81, whereby the heat transfer member 85 is pressed against the heater 81 due to the elastic restoring force of the heat transfer member 85.

In other words, in the heater unit 80 according to the third exemplary embodiment, the heat transfer member 85 is pressed against the inner peripheral surface of the heater 81 due to the elastic restoring force of the heat transfer member 85. Moreover, the heater 81 is pressed against the inner peripheral surface of the fixing belt 61 due to the pressing force by the heat transfer member 85 and the elastic restoring force of the heater 81.

As a result, in the third exemplary embodiment, when the heater unit 80 is installed within the inner periphery of the fixing belt 61, the inner peripheral surface of the fixing belt 61 and the heater 81 are in close contact with each other, and the heater 81 and the heat transfer member 85 are in close contact with each other.

Thus, in the third exemplary embodiment, when sheets are successively transported to the nip N (see FIG. 3) of the fixing unit 60, heat retained in the non-sheet-passing regions Fb (see FIG. 8B) of the heater 81 is conducted to the sheet-passing region Fa (see FIG. 8B) via the heat transfer member 85.

Furthermore, in the third exemplary embodiment, since the heat transfer member 85 is provided separately from the heater 81, the elastic restoring force of the heater 81 occurring due to deformation of the heater 81 may be prevented from being inhibited by the heat transfer member 85.

In the example shown in FIGS. 13A and 13B, the heater 81 used has a layer configuration obtained by laminating the heat-generating layer 811, the insulation layer 812, and the support metallic layer 813. Alternatively, for example, a heater 81 (see FIG. 6B) formed by laminating the heat-generating layer 811, the insulation layer 812, the support metallic layer 813, and the thermal-diffusion metallic layer 814 may be used, as in the first exemplary embodiment, or a heater 81 (see FIG. 12) formed by laminating the thermal diffusion sheet 815 in place of the thermal-diffusion metallic layer 814 may be used, as in the second exemplary embodiment.

For example, in a case where the heater 81 according to the first exemplary embodiment is used, the heat transfer member 85 is provided in contact with the thermal-diffusion metallic layer 814, and heat generated in the heat-generating layer 811 is conducted by the thermal-diffusion metallic layer 814 and the heat transfer member 85. In a case where the heater 81 according to the second exemplary embodiment is used, the heat transfer member 85 is provided in contact with the thermal diffusion sheet 815, and heat generated in the heat-generating layer 811 is conducted by the thermal diffusion sheet 815 and the heat transfer member 85.

Fourth Exemplary Embodiment

Figure 14:
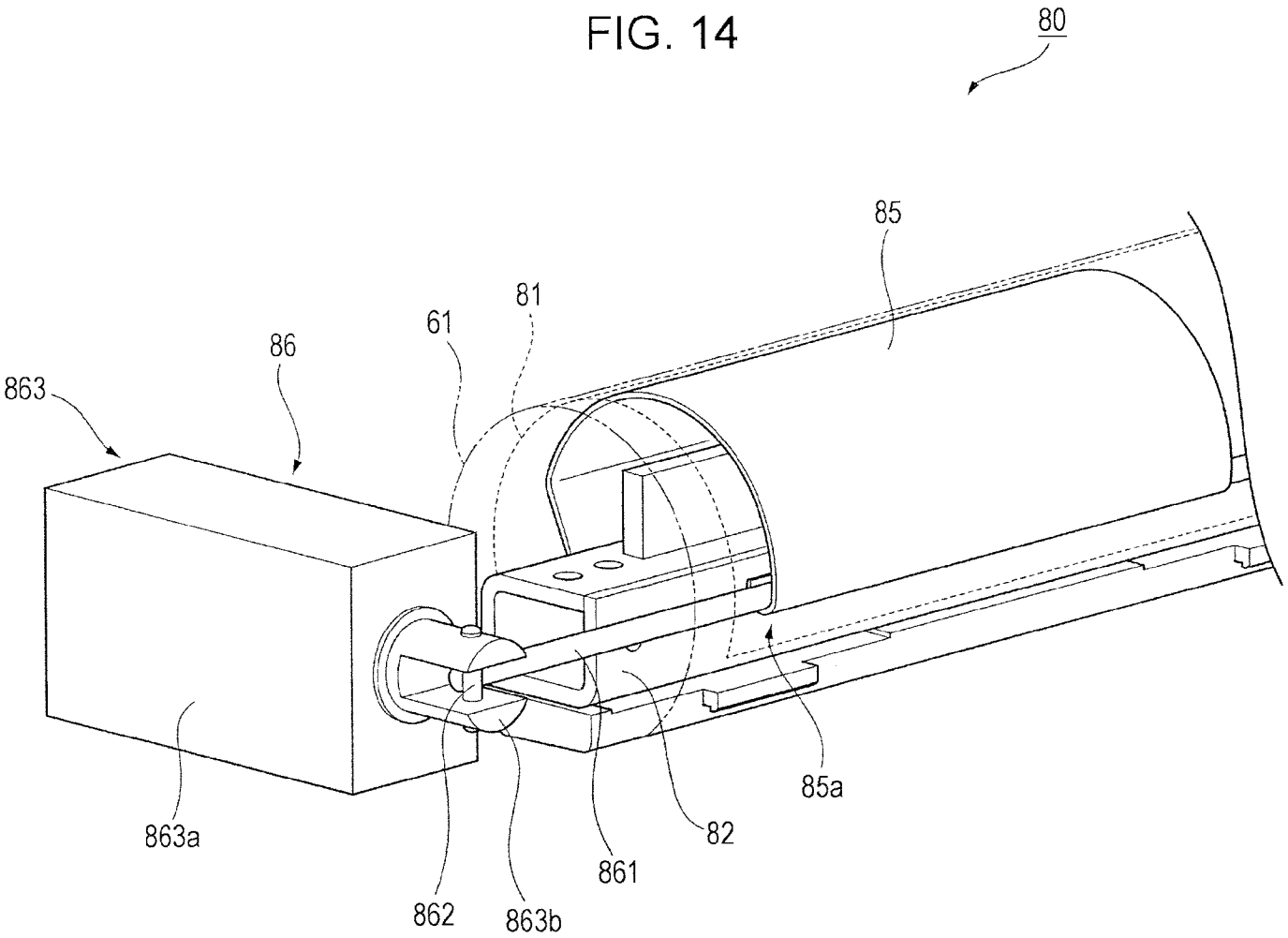
FIG. 14 is a perspective view illustrating the configuration of a heater unit according to a fourth exemplary embodiment.
Figure 15B:
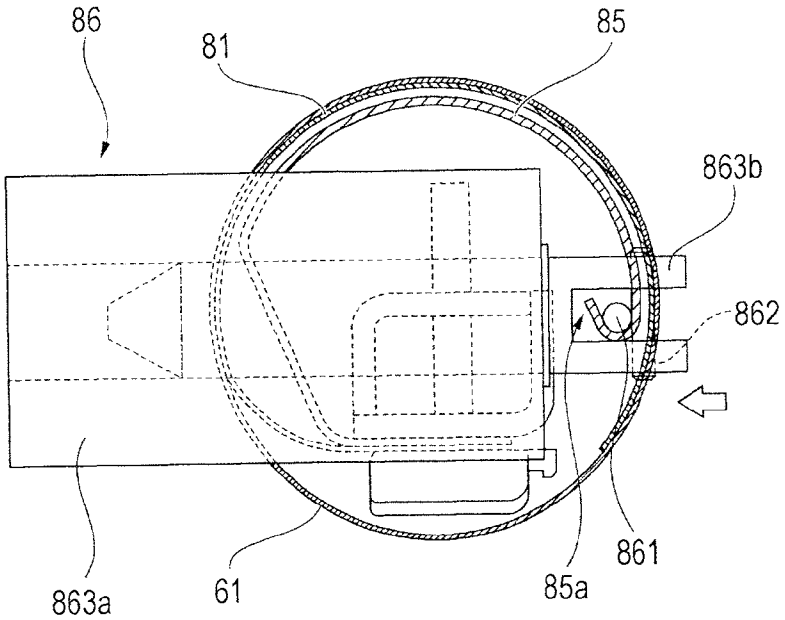
FIGS. 15A and 15B illustrate the operation of the heater unit according to the fourth exemplary embodiment.
Figure 15A:
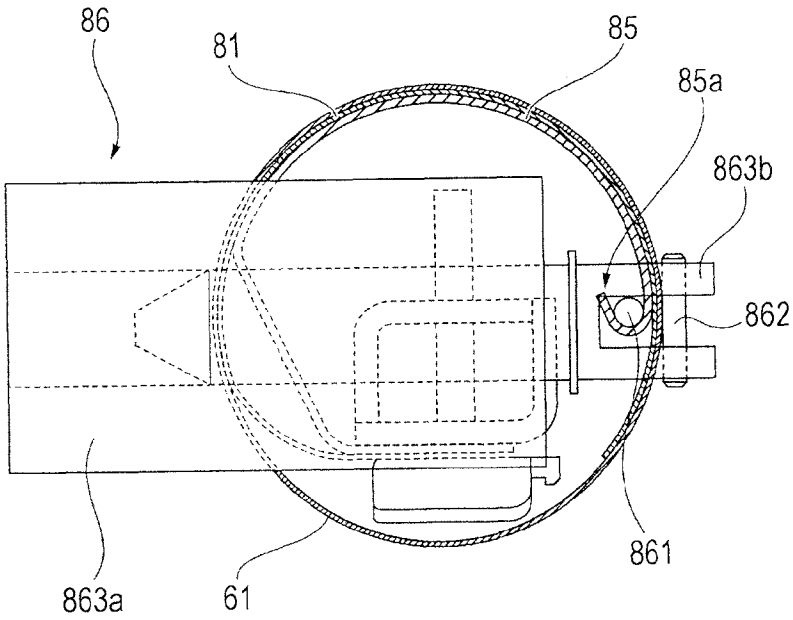

Next, a fourth exemplary embodiment of the present invention will be described. FIG. 14 is a perspective view illustrating the configuration of a heater unit 80 according to the fourth exemplary embodiment. FIGS. 15A and 15B illustrate the operation of the heater unit 80 according to the fourth exemplary embodiment and correspond to diagrams of the heater unit 80 according to the fourth exemplary embodiment, as viewed in the axial direction.

In addition to the heater unit 80 described in the third exemplary embodiment, the heater unit 80 according to the fourth exemplary embodiment further has a driver 86 as an example of a switching unit that drives the heat transfer member 85.

The heat transfer member 85 according to the fourth exemplary embodiment is similar to the heat transfer member 85 according to the third exemplary embodiment (see FIGS. 12A and 12B) in that one of the lengthwise edges is attached to and supported by the support frame 82. Moreover, as shown in FIGS. 14, 15A, and 15B, the heat transfer member 85 according to the fourth exemplary embodiment has a bent portion 85*a* formed by bending the edge that is not attached to the support frame 82 toward the inner periphery of the fixing belt 61.

The driver 86 has a shaft 861 that extends in the longitudinal direction of the heater 81 and onto which the bent portion 85*a* of the heat transfer member 85 is hooked, a regulation member 862 provided in contact with each of opposite longitudinal ends of the shaft 861 so as to regulate the movement of the shaft 861, and a moving member 863 that moves the regulation member 862.

In the fourth exemplary embodiment, the moving member 863 is constituted of a solenoid and has a solenoid body 863*a* and a plunger 863*b* protruding from the solenoid body 863*a*. Based on control by the controller 31 (see FIG. 1), the plunger 863*b* is movable in directions for increasing and decreasing an amount by which it protrudes from the solenoid body 863*a*. The regulation member 862 is attached to the plunger 863*b* of the moving member 863.

Next, the operation of the heater unit 80 will be described. Based on control by the controller 31, the heater unit 80 according to the fourth exemplary embodiment is switchable between a first state in which the heat transfer member 85 is in contact with the heater 81 and a second state in which the heat transfer member 85 is separated from the heater 81. FIG. 15A illustrates the heater unit 80 in the first state, and FIG. 15B illustrates the heater unit 80 in the second state.

In the heater unit 80 in the first state, the plunger 863*b* protrudes from the solenoid body 863*a* in the moving member 863 by a first predetermined protrusion amount. As shown in FIG. 15A, as the plunger 863*b* protrudes in the heater unit 80 in the first state, the regulation member 862 attached to the end of the plunger 863*b* becomes positioned at the outer peripheral side of the fixing belt 61, when viewed in the axial direction (i.e., Y direction).

Thus, in the first state shown in FIG. 15A, the regulation member 862 is separated from the shaft 861. In other words, in the heater unit 80 in the first state, an external force by the regulation member 862 is not applied to the shaft 861 and the heat transfer member 85 attached to the shaft 861. As a result, as shown in FIG. 15A, in the heater unit 80 in the first state, the heat transfer member 85 is in contact with the heater 81 due to the elastic restoring force of the heat transfer member 85.

When the controller 31 switches the heater unit 80 from the first state to the second state, the plunger 863*b* moves leftward so as to be pulled toward the solenoid body 863*a*, as shown in FIG. 15B. As a result, the plunger 863*b* protrudes from the plunger 863*b* by a second protrusion amount, which is smaller than the first protrusion amount.

As the plunger 863*b* is pulled toward the solenoid body 863*a*, the regulation member 862 moves toward the inner periphery of the fixing belt 61 so as to abut on the shaft 861.

As a result, the shaft 861 is pressed by the regulation member 862 so as to move toward the inner periphery of the fixing belt 61. Then, as the shaft 861 moves, the heat transfer member 85 attached to the shaft 861 deforms. Specifically, as the shaft 861 moves, the bent portion 85*a* moves toward the inner periphery of the fixing belt 61, so that the heat transfer member 85 deforms to have curvature larger (i.e., a radius of curvature smaller) than that in the first state.

Thus, as shown in FIG. 15B, in the heater unit 80 in the second state, the heat transfer member 85 is separated from the heater 81.

Accordingly, based on control by the controller 31, the heater unit 80 according to the fourth exemplary embodiment is switchable by the driver 86 between the first state in which the heat transfer member 85 is in contact with the heater 81 and the second state in which the heat transfer member 85 is separated from the heater 81.

By employing such a configuration, for example, when the fixing unit 60 is activated or when the fixing unit 60 in a dormant state is reactivated, the heater unit 80 may be set to the second state in which the heat transfer member 85 is separated from the heater 81. In this case, conduction of heat generated in the heat-generating layer 811 from the heater 81 to the heat transfer member 85 is suppressed.

Furthermore, when the temperature of the fixing belt 61 increases to a predetermined temperature, the heater unit 80 is set to the first state in which the heat transfer member 85 is in contact with the heater 81, so that heat generated in the heater 81 is diffused in the planar direction via the heat transfer member 85.

Specifically, heat retained in the non-sheet-passing regions Fb (see FIG. 8B) of the heater 81 is conducted and diffused to the heat transfer member 85 that is in contact with the heater 81 in the first state.

In the fourth exemplary embodiment, although the heat transfer member 85 is set in contact with the inner peripheral surface of the heater 81 when the heater unit 80 is in the first state, the heat transfer member 85 does not have to be entirely in contact with the heater 81 when the heater unit 80 is in the first state. Specifically, the heat transfer member 85 may be in contact with at least the heat-generating region 81*a* (see FIG. 8A) of the heater 81.

Moreover, when the heater unit 80 is in the second state, the heat transfer member 85 does not have to be completely separated from the heater 81 so long as at least a portion of the heat transfer member 85 is separated from the heater 81 and the contact area between the heater 81 and the heat transfer member 85 is smaller than that in the first state.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable endless fixing member that fixes a toner image onto a recording medium; and a heating member that includes a heat-generating layer that generates heat by being supplied with electricity, an insulation layer that encloses the heat-generating layer therein so as to electrically insulate the heat-generating layer, a metallic layer that is laminated on a first surface of the insulation layer, has higher rigidity than the insulation layer, and generates an elastic restoring force, and a thermally conductive layer that is laminated on a second surface of the insulation layer, has lower rigidity than the metallic layer, and has higher thermal conductivity than the insulation layer and the metallic layer, wherein the heating member is supported by one edge of the fixing member in a circumferential direction thereof, elastically deforms by being pressed against an inner peripheral surface of the fixing member, and heats the fixing member.

2. The fixing device according to claim 1, wherein the thermally conductive layer is composed of a metallic material having higher rigidity than the insulation layer.

3. The fixing device according to claim 1, wherein the thermally conductive layer is composed of a sheet-shaped carbon-based material having higher rigidity than the insulation layer.

4. A heating member comprising:

a heat-generating layer that generates heat by being supplied with electricity;

an insulation layer that encloses the heat-generating layer therein so as to electrically insulate the heat-generating layer;

a metallic layer that is laminated on a first surface of the insulation layer, has higher rigidity than the insulation layer, and generates an elastic restoring force; and a thermally conductive layer that is laminated on a second surface of the insulation layer, has lower rigidity than the metallic layer, and has higher thermal conductivity than the insulation layer and the metallic layer, wherein the heating member elastically deforms by being pressed against a heated member and heats the heated member.

5. A heating member comprising:

a heat-generating layer that generates heat by being supplied with electricity;

an insulation layer that encloses the heat-generating layer therein so as to electrically insulate the heat-generating layer;

a metallic layer that is laminated on a first surface of the insulation layer, has higher rigidity than the insulation layer, and generates an elastic restoring force; and a thermally conductive layer that is laminated on a second surface of the insulation layer, has lower rigidity than the metallic layer, and has higher thermal conductivity than the insulation layer and the metallic layer, wherein the heating member elastically deforms by being pressed against an endless fixing member, which fixes a toner image onto a recording medium, and heats the fixing member.

6. A fixing device comprising:

a rotatable endless fixing member that fixes a toner image onto a recording medium;

a heating member that includes a heat-generating layer that generates heat by being supplied with electricity, an insulation layer that encloses the heat-generating layer therein so as to electrically insulate the heat-generating layer, and a metallic layer that is laminated on the insulation layer, has higher rigidity than the insulation layer, and generates an elastic restoring force, wherein the heating member is supported by one edge of the fixing member in a circumferential direction thereof, elastically deforms when a first surface of the heating member that is provided with the metallic layer is pressed against an inner peripheral surface of the fixing member, and heats the fixing member; and a thermally conductive member that is in contact with a second surface of the heating member and that has higher thermal conductivity than the insulation layer and the metallic layer of the heating member.

7. The fixing device according to claim 6, wherein the thermally conductive member is supported by one edge of the fixing member in the circumferential direction thereof and elastically deforms by coming into contact with the second surface of the heating member.

8. The fixing device according to claim 6, further comprising:

a switching unit that switches the thermally conductive member between a state in which the thermally conductive member is in contact with the heating member and a state in which the thermally conductive member is separated from the heating member.

9. An image forming apparatus comprising:

a toner-image forming unit that forms a toner image;

a transfer unit that transfers the toner image onto a recording medium; and a fixing unit that fixes the toner image transferred on the recording medium onto the recording medium, wherein the fixing unit includes a rotatable endless fixing member that fixes the toner image onto the recording medium, and a heating member that includes a heat-generating layer that generates heat by being supplied with electricity, an insulation layer that encloses the heat-generating layer therein so as to electrically insulate the heat-generating layer, a metallic layer that is laminated on a first surface of the insulation layer, has higher rigidity than the insulation layer, and generates an elastic restoring force, and a thermally conductive layer that is laminated on a second surface of the insulation layer, has lower rigidity than the metallic layer, and has higher thermal conductivity than the insulation layer and the metallic layer, wherein the heating member is supported by one edge of the fixing member in a circumferential direction thereof, elastically deforms by being pressed against an inner peripheral surface of the fixing member, and heats the fixing member.

10. An image forming apparatus comprising:

a toner-image forming unit that forms a toner image;

a transfer unit that transfers the toner image onto a recording medium; and a fixing unit that fixes the toner image transferred on the recording medium onto the recording medium, wherein the fixing unit includes a rotatable endless fixing member that fixes the toner image onto the recording medium, a heating member that includes a heat-generating layer that generates heat by being supplied with electricity, an insulation layer that encloses the heat-generating layer therein so as to electrically insulate the heat-generating layer, and a metallic layer that is laminated on the insulation layer, has higher rigidity than the insulation layer, and generates an elastic restoring force, wherein the heating member is supported by one edge of the fixing member in a circumferential direction thereof, elastically deforms when a first surface of the heating member that is provided with the metallic layer is pressed against an inner peripheral surface of the fixing member, and heats the fixing member, and a thermally conductive member that is in contact with a second surface of the heating member and that has higher thermal conductivity than the insulation layer and the metallic layer of the heating member.

* * * * *